US006230644B1

(12) United States Patent
Passen et al.

(10) Patent No.: US 6,230,644 B1
(45) Date of Patent: May 15, 2001

(54) DOCK AND BUOYANT MODULE ADAPTED TO BE CONNECTED TO A PILE

(75) Inventors: Selvin Passen, Zephyr Cove, NV (US); Mark Levin, Baltimore, MD (US)

(73) Assignee: Eastern Flotation Systems, Inc., Baltimore, MD (US)

( * ) Notice: Subject to any disclaimer, the term of this patent is extended or adjusted under 35 U.S.C. 154(b) by 0 days.

(21) Appl. No.: 09/492,147

(22) Filed: Jan. 27, 2000

(51) Int. Cl.[7] ..... B63B 35/44
(52) U.S. Cl. ..... 114/263; 114/267; 405/219
(58) Field of Search ..... 405/3, 218, 219; 114/263, 266, 267, 45, 48, 44; 440/36

(56) References Cited

U.S. PATENT DOCUMENTS

| | | | | |
|---|---|---|---|---|
| Re. 24,837 | | 6/1960 | Usab . | |
| 2,857,872 | | 10/1958 | Usab . | |
| 3,091,203 | | 5/1963 | Usab . | |
| 3,128,737 | | 4/1964 | Usab . | |
| 3,276,211 | * | 10/1966 | Drake | 405/3 |
| 3,463,271 | * | 8/1969 | St. Louis | 405/3 |
| 3,603,276 | * | 9/1971 | De Lisle | 114/45 |
| 3,691,974 | * | 9/1972 | Seiford, Sr. et al. | 114/266 |
| 4,318,362 | | 3/1982 | Jung . | |
| 4,559,891 | | 12/1985 | Shorter, Jr. . | |
| 4,683,833 | | 8/1987 | Meriwether . | |
| 4,709,647 | | 12/1987 | Rytand . | |
| 4,715,307 | | 12/1987 | Thompson . | |
| 4,799,445 | | 1/1989 | Meriwether . | |
| 4,887,654 | | 12/1989 | Rytand . | |
| 4,940,021 | | 7/1990 | Rytand . | |
| 4,947,780 | | 8/1990 | Finn . | |
| 4,974,538 | | 12/1990 | Meriwether . | |
| 5,044,296 | | 9/1991 | Finn . | |
| 5,081,946 | | 1/1992 | Nannig et al. . | |
| 5,199,371 | | 4/1993 | Meriwether . | |

* cited by examiner

*Primary Examiner*—Ed Swinehart
(74) *Attorney, Agent, or Firm*—Lowe Hauptman Gilman & Berner, LLP

(57) ABSTRACT

A floating dock including many buoyant wharf modules having approximately the same exterior size and shape, as well as density properties, relative to a pile extending through a vertically extending passage in one of the modules. The passage has four straight walls defining a square in the horizontal plane. A roller is at each corner of the square. The roller which is normally spaced from the cylindrical pile, contacts the pile as the dock bobs. A bracket mounted on a carrier having fixed tabs encased in a concrete deck of the module can be moved to different radial positions relative to the center, vertical axis of the passage, to accommodate different diameter piles. A permanent mold form for the concrete includes the lips extending upwardly from the passage side walls and lips extending upwardly from exterior side walls of a closed shell having foam therein. The shell has a roof forming the permanent mold form floor. The roof extends between the lips.

36 Claims, 6 Drawing Sheets

DOCK AND BUOYANT MODULE ADAPTED TO BE CONNECTED TO A PILE

FIELD OF THE INVENTION

The present invention relates generally to floating docks and, more particularly, to a buoyant module for connecting a floating dock to a pile, wherein the module includes an opening bounded by rollers for engaging the pile.

BACKGROUND ART

Floating docks frequently are maintained in place with the aid of one or more piles driven into a seabed where the dock is located. Ropes or other similar structures frequently secure the docks to the piles. Sometimes, old tires serve as buffers between the piles and docks.

This typical prior art structure, although frequently used, has numerous deficiencies. For example, the ropes and tires must be replaced often. More importantly, the dock moves up and down with wave action of a body of water where the dock is floating, causing the dock frequently to be unstable with respect to the pile.

Many docks are now formed by buoyant module structures that are made in a factory and transported to a dock site, where the modules are connected together to form the dock. To our knowledge, little attention has been paid to securing such docks to a pile. The same prior art structures which have been used for years, as described above, have generally been employed to secure docks formed of buoyant modular structures to a pile. Because of the numerous advantages associated with modular docks, it is advantageous to provide a buoyant modular structure for a dock with provisions for enabling the entire dock to be stably secured to a pile.

We are aware of prior art patents disclosing various arrangements for connecting buoyant modules of floating docks to piles. To our knowledge, none of the structures disclosed in the prior art patents have been commercialized.

Usab, U.S. Pat. No. 3,091,203, discloses a floating dock including a metal plate attached to one end of a buoyant module. The plate includes a tube having an inner diameter slightly in excess of the outer diameter of a pile. The plate is fit over the pile or the pile is sunk and built around the tube. As the floating module and the deck of which it is a part move up and down in response to wave action, the tube inner wall and the pile outer diameter contact each other, likely causing substantial wear of both parts.

Finn, U.S. Pat. No. 4,947,780, discloses a metal frame having an opening with a square cross section having side walls carrying rollers for engaging a pile having a square cross section, corresponding generally in size with the opening in the frame. The frame is mounted on an outboard portion of a buoyant module included in a floating deck. The Finn arrangement requires different frames for piles having different areas. In addition, as the dock rises and falls due to wave and tidal action, a substantial amount of torque can be exerted by the frame on the module to which the frame is connected. Consequently, it appears that the frame has a tendency to become loosened from the buoyant module to which it is attached and the dock has a tendency to be unstable as a result of wave action.

Thompson, U.S. Pat. No. 4,715,307, discloses a frame with a square cross section at the end of a finger pier formed by numerous buoyant modules. Rollers mounted on a side wall arrangement of the frame engage a cylindrical exterior wall of the pile. A problem with the structure disclosed in the Thompson patent is that different size frames must be employed for piles having different diameters. In addition, the frame does not appear to have any substantial depth and is apparently merely a metal plate mounted as an appendage on one end of a float module having a lower portion filled with cellular material. A dock including the structure disclosed by the Thompson patent would apparently have a tendency to float unstably in response to wave action.

Jung, U.S. Pat. No. 4,318,362, discloses a floating concrete dock including a finger pier having at one end thereof an opening for receiving a pile. In addition, a triangular web connecting the finger pier to a main pier includes a similar opening. Jung states that a cylindrical bore which functions as a guide on the pier for the piles can extend throughout the thickness of a header or a finger deck portion. However, Jung provides no details as to how these structures are achieved.

It is, accordingly, an object of the present invention to provide a new and improved floating dock with provisions for securing the dock to one or more piles.

Another object of the invention is to provide a new and improved buoyant wharf module having provisions for accepting a pile.

A further object of the invention is to provide a new and improved buoyant wharf module arranged to provide a great amount of stability to a floating dock with which the module is associated.

An additional object of the invention is to provide a new and improved buoyant wharf module having provisions for accepting cylindrical piles having different diameters.

SUMMARY OF THE INVENTION

One aspect of the invention relates to a buoyant module for securing other buoyant structures of a floating dock to a cylindrical pile fixedly mounted in a body of water, wherein the pile has an exterior cylindrical wall and an upper segment extending substantially above the surface of the body of water. The module comprises an arrangement for connecting the module to the other buoyant structures, as well as an upper deck portion and a lower buoyant portion. An interior wall arrangement forms a passage that extends between bottom and top surfaces of the buoyant module. The passage has plural sides joined to form plural corners in a horizontal plane. A roller having a horizontally disposed axis is at each of the corners. The sizes, geometry and locations of the passage and rollers relative to the pile are such that (1) the pile is always spaced from the sides, (2) there can be a gap between exterior cylindrical walls of all the rollers and the exterior cylindrical wall of the pile, (c) different ones of the rollers contact the upper segment of the pile at different times as the dock bobs in response to wave action of the body of water, and (d) only one of the rollers contacts the pile at a time.

Another aspect of the invention relates to a buoyant module for securing other buoyant structures of a floating dock to a pile fixedly mounted in a body of water, wherein the pile has an upper segment extending substantially above the surface of the body of water. The module comprises an arrangement for connecting the module to the other buoyant structures, as well as an upper deck portion and a lower buoyant portion. An interior wall arrangement forms a passage that extends between bottom and top surfaces of the buoyant module. A plurality of rollers, each having a horizontally disposed axis, are fixedly mounted to extend into a region vertically aligned with the passage. The sizes and locations of the pile, passage and rollers are such that (1) the pile is always spaced from side walls of the passage, (2) there can be a gap between exterior cylindrical walls of all the rollers and the exterior cylindrical wall of the pile, (3) different ones of the rollers can contact the upper segment of the pile at different times as the dock bobs in response to wave action of the body of water, and (4) only one of the rollers can contact the pile at a time. A structure carrying the rollers is arranged so exterior cylindrical surfaces of the rollers can be fixedly mounted at differing radial positions relative to a central vertical extending axis of the passage so piles having differing diameters can fit into the passage by changing the radial position of the rollers relative to the axis.

A further aspect of the invention concerns a buoyant module for securing other buoyant structures of a floating dock to a pile fixedly mounted in a body of water, wherein the pile has an upper segment extending substantially above the surface of the body of water. The module comprises an arrangement for connecting the module to the other buoyant structures, as well as an upper deck portion and a lower buoyant portion. An interior wall arrangement forms a passage that extends between bottom and top surfaces of the buoyant module.

A plurality of rollers, each having a horizontally disposed axis, are fixedly mounted to extend into a region vertically aligned with the passage. The sizes and locations of the pile, passage and rollers are such that (1) the pile is always spaced from side walls of the passage, (2) there can be a gap between exterior cylindrical walls of all the rollers and the exterior cylindrical wall of the pile, (3) different ones of the rollers can contact the upper segment of the pile at different times as the dock bobs in response to wave action of the body of water, and (4) only one of the rollers can contact the pile at a time. The lower portion includes a closed, water impervious molded shell having exterior walls. The interior wall arrangement is formed in the molded shell. A permanent mold form for a molded mass includes (1) lips extending upwardly from the interior wall arrangement and exterior walls of the shell, and (2) a floor extending between the lips. The floor forms a roof of the shell. A molded mass permanently fills the mold form.

An additional aspect of the invention relates to a buoyant module for securing other buoyant structures of a floating dock to a pile fixedly mounted in a body of water, wherein the pile has an upper segment extending substantially above the surface of the body of water. The module comprises an arrangement for connecting the module to the other buoyant structures, as well as an upper deck portion and a lower buoyant portion. An interior wall arrangement forms a passage that extends between bottom and top surfaces of the buoyant module. A plurality of rollers, each having a horizontally disposed axis, are fixedly mounted to extend into a region vertically aligned with the passage. The sizes and locations of the pile, passage and rollers are such that (1) the pile is always spaced from side walls of the passage, (2) there can be a gap between exterior cylindrical walls of all the rollers and the exterior cylindrical wall of the pile, (3) different ones of the rollers can contact the upper segment of the pile at different times as the dock bobs in response to wave action of the body of water, and (4) only one of the rollers can contact the pile at a time. The lower portion includes a shell having first and second molded parts that are bonded together so an intersection of the first and second molded parts is on the interior side wall arrangement. The first and second parts when bonded together include the interior side wall arrangement.

Still a further aspect of the invention relates to a buoyant module for securing other buoyant structures of a floating dock to a pile fixedly mounted in a body of water, wherein the pile has an upper segment extending substantially above the surface of the body of water. The module comprises an arrangement for connecting the module to the other buoyant structures, as well as an upper deck portion, including a molded mass having a density greater than water and a lower buoyant portion. An interior wall arrangement forms a passage that extends between bottom and top surfaces of the buoyant module. A plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time. A carrier for the rollers has a portion encapsulated in the molded mass so the carrier is fixedly secured to the molded mass.

Still another aspect of the invention relates to a floating dock adapted to be secured to an upper, above water segment of a pile fixedly mounted in a seabed. The dock comprises an upper deck portion and a lower buoyant portion. An interior wall arrangement forms a passage that extends between bottom and top surfaces of the dock. The passage includes plural sides joined to form plural corners in a horizontal plane. A roller having a horizontally disposed axis is at each of the corners. The sizes, geometry and locations of the passage and rollers relative to the pile are such that (1) the pile is always spaced from the sides, (2) there can be a gap between exterior cylindrical walls of all the rollers and the exterior cylindrical wall of the pile, (3) different ones of the rollers contact the upper segment of the pile at different times as the dock bobs in response to wave action of the body of water, and (4) only one of the rollers contacts the pile at a time.

Still an added aspect of the invention relates to a floating dock adapted to be secured to an upper, above water segment of a pile fixedly mounted in a seabed, wherein the dock comprises an upper deck portion, a lower buoyant portion, and an interior wall arrangement forming a passage extending between bottom and top surfaces of the dock. A plurality of rollers, each having a horizontally disposed axis, are fixedly mounted to extend into a region vertically aligned with the passage. The sizes and locations of the pile, passage and rollers are such that (1) the pile is always spaced from side walls of the passage, (2) there can be a gap between exterior cylindrical walls of all the rollers and the exterior cylindrical wall of the pile, (3) different ones of the rollers can contact the upper segment of the pile at different times as the dock bobs in response to wave action of the body of water, and (4) only one of the rollers can contact the pile at a time. A structure carrying the rollers is arranged so exterior cylindrical surfaces of the rollers can be fixedly mounted at differing radial positions relative to a central vertical extending axis of the passage so piles having differing diameters can fit into the passage by changing the radial position of the rollers relative to the axis.

Another aspect of the invention concerns a floating dock adapted to be secured to an upper, above water segment of a pile fixedly mounted in a seabed, wherein the dock comprises an upper deck portion and a lower buoyant portion. The upper deck portion includes (1) a molded mass having a density greater than water, (2) an interior wall arrangement forming a passage extending between bottom and top surfaces of the dock, (3) a plurality of rollers each having a horizontally disposed axis, and (4) a carrier for the rollers. The rollers are fixedly mounted to extend into a region vertically aligned with the passage. The sizes and locations of the pile, passage and rollers are such that (i) the pile is always spaced from side walls of the passage, (ii) there can be a gap between exterior cylindrical walls of all the rollers and the exterior cylindrical wall of the pile, (iii) different ones of the rollers can contact the upper segment of the pile at different times as the dock bobs in response to wave action of the body of water, and (iv) only one of the rollers can contact the pile at a time. The carrier has a portion encapsulated in the molded mass so the carrier is fixedly secured to the molded mass.

The above and still further objects, features and advantages of the present invention will become apparent upon consideration of the following detailed description of a specific embodiment thereof, especially when taken in conjunction with the accompanying drawings.

DETAILED DESCRIPTION OF THE DRAWING

Figure 1:
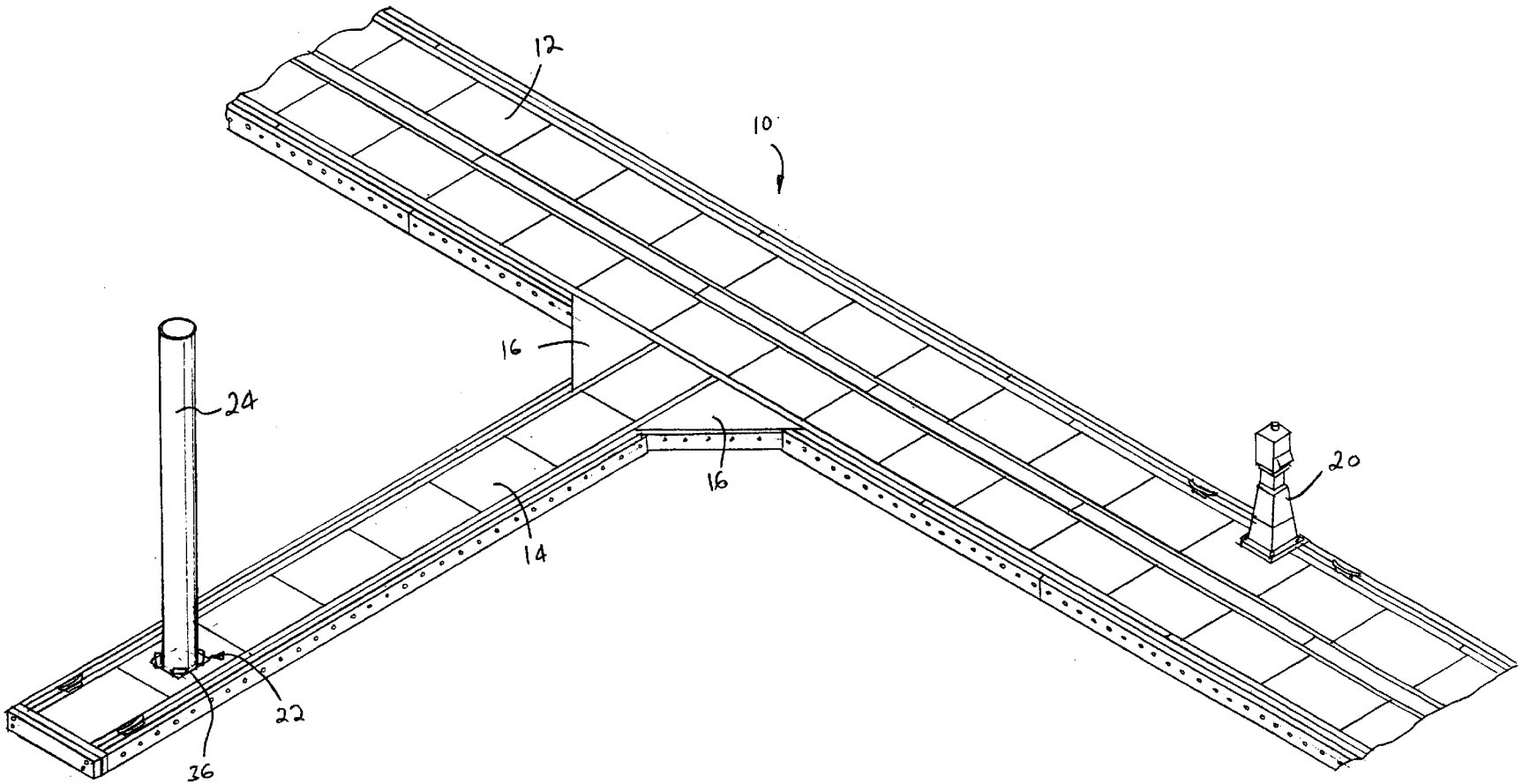
FIG. 1 is a perspective view of a floating dock coupled to a pile, wherein the dock includes a buoyant wharf module surrounding the pile, in accordance with a preferred embodiment of the present invention.

Reference is now made to FIG. 1 of the drawing wherein floating dock 10 is illustrated as including main pier portion 12 and finger pier portion 14, which extends generally at right angles to the main pier portion. Main pier portion 12 includes first and second rows of buoyant wharf modules, in side-by-side relationship with each other, while finger pier portion 14 includes a single row of buoyant wharf modules. Trusses 16 connect the modules of main pier portion 12 to the modules of finger pier portion 14.

All the buoyant wharf modules of finger pier portions 12 and 14 are generally constructed in the same manner, except for the module 18 that carries utility tower 20 and module 22 that surrounds pile 24; module 22 is frequently referred to as a pile float. (For convenience, all of the identical modules of dock 10 are referred to by reference numeral 17, i.e., all of the modules of FIG. 1 are modules 17 except modules 18 and 22.) A preferred construction for all the modules, except module 22, is disclosed in the co-pending, commonly assigned application of Passen et al., Lowe Hauptman Gopstein Gilman & Berner, Ser. No. 09/426,643, filed Oct. 25, 1999. It is to be understood, however, that other types of buoyant modules can be employed and that certain aspects of the invention are not limited to the type of floating dock disclosed in the co-pending application.

All of modules 17, 18 and 22 have the same exterior shape and dimensions. In particular, each of modules 17, 20 and 22 has a right parallelepiped as an exterior shape, such that the exterior walls of the modules are straight and extend in the vertical plane. Each of modules 17, 20 and 22 typically has a length of about five feet, a width of about three feet, and a depth of about 26 inches. All of modules 17, 18 and 22 include a buoyant foam filled lower shell and a concrete deck having tunnels with rods extending through them for connection to wales that extend lengthwise of the modules. The density of corresponding parts of the different modules are the same, so the buoyant properties of modules 17, 20 and 22 are substantially the same. Each of modules 17, 20 and 22 also includes provisions for draining water incident on the deck, as well as indentations in the bottom thereof for receiving forks of an industrial fork lift truck.

Module 22 includes four cylindrical rollers 25 that are mounted for rotation about a horizontal axis to engage the periphery of pile 24 as finger pair 14 and dock 10 move up and down in response to wave and tidal action of the body of water where the dock is floating. Rollers 25 are preferably formed of a hard, high-density nylon for long life as they ride up and down on and bump into pile 24. In the preferred embodiment, module 22 that surrounds pile 24 is located close to the end of finger pier 14, being spaced from the end of the finger pier by one of buoyant float modules 17. Hence, in the preferred embodiment, the axis of pile 24 is aligned with the longitudinal, center axis of pier 14 and is approximately 7½ feet from the end of finger pier 14 opposite from main pier section 12. Locating pile 24 along the axis of finger pier 14 and inwardly from the end of the finger pier provides greater stability to the floating dock while the dock is subjected to substantial wave action, than is achieved by positioning the pile at the extreme end of the finger pier.

Figure 2:
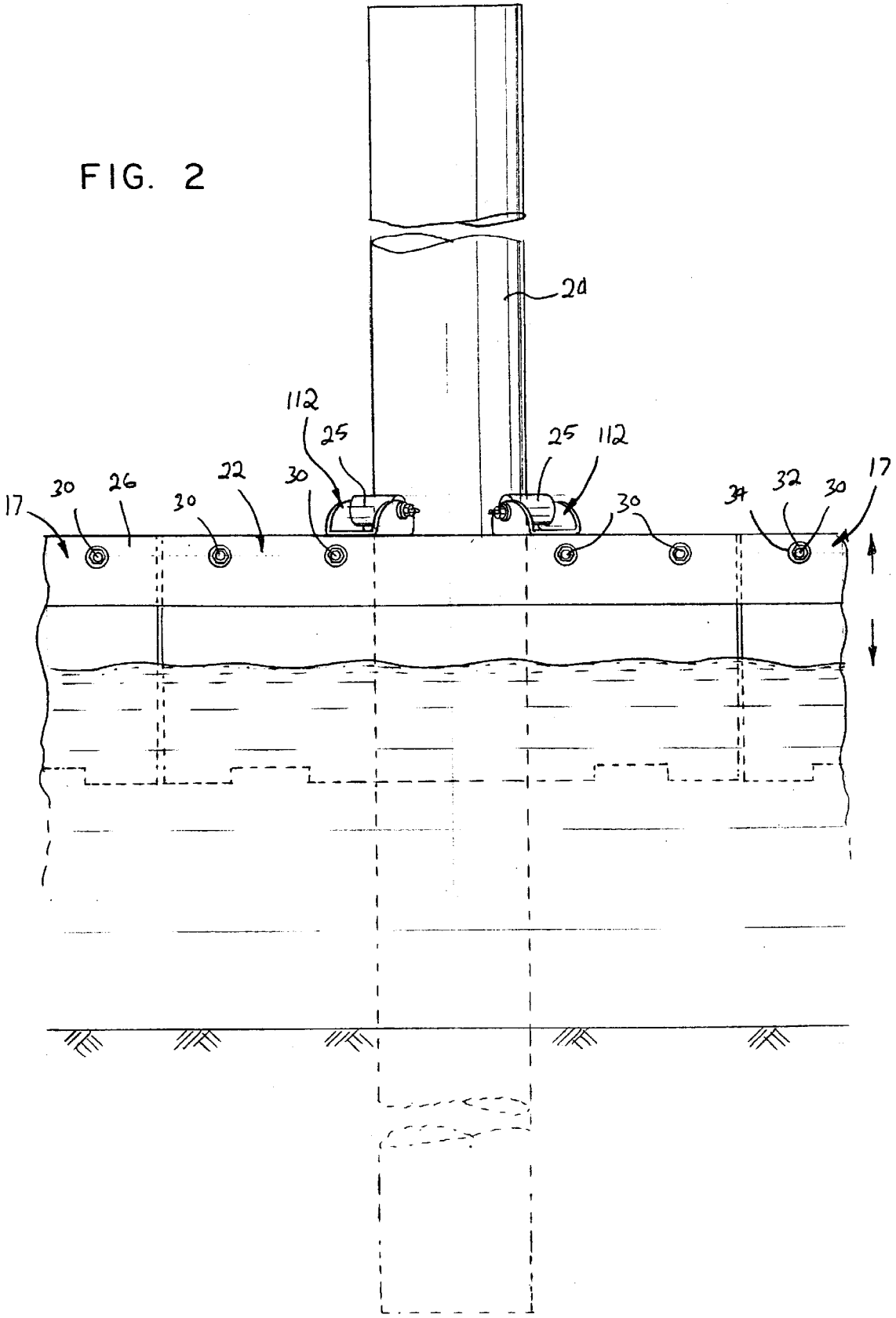
FIG. 2 is a side view of a portion of the floating dock of FIG. 1, specifically including the pile and the buoyant wharf modules surrounding the pile.
Figure 3:
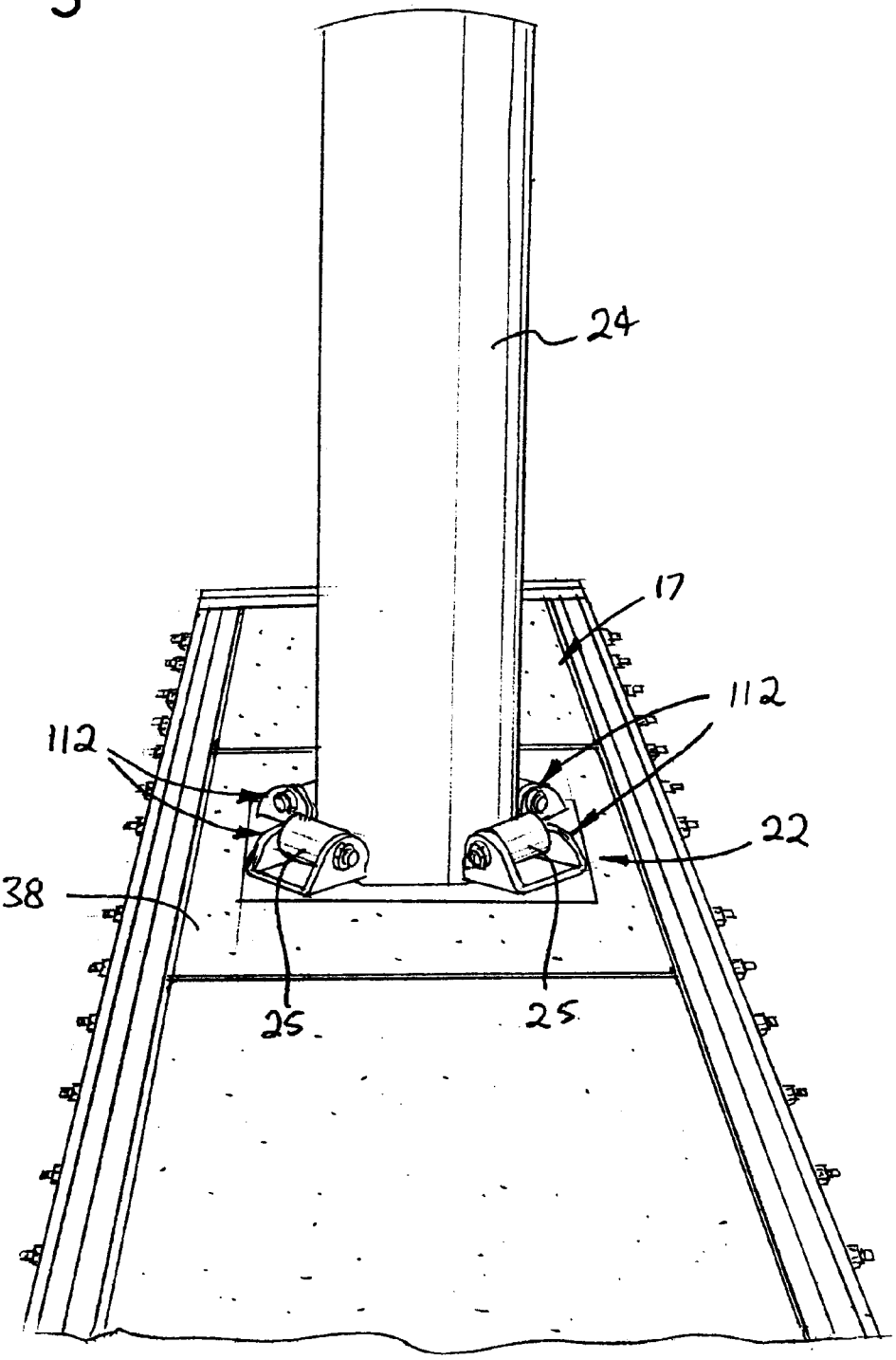
FIG. 3 is a perspective view of the pile and the wharf module illustrated in FIGS. 1 and 2.
Figure 4:
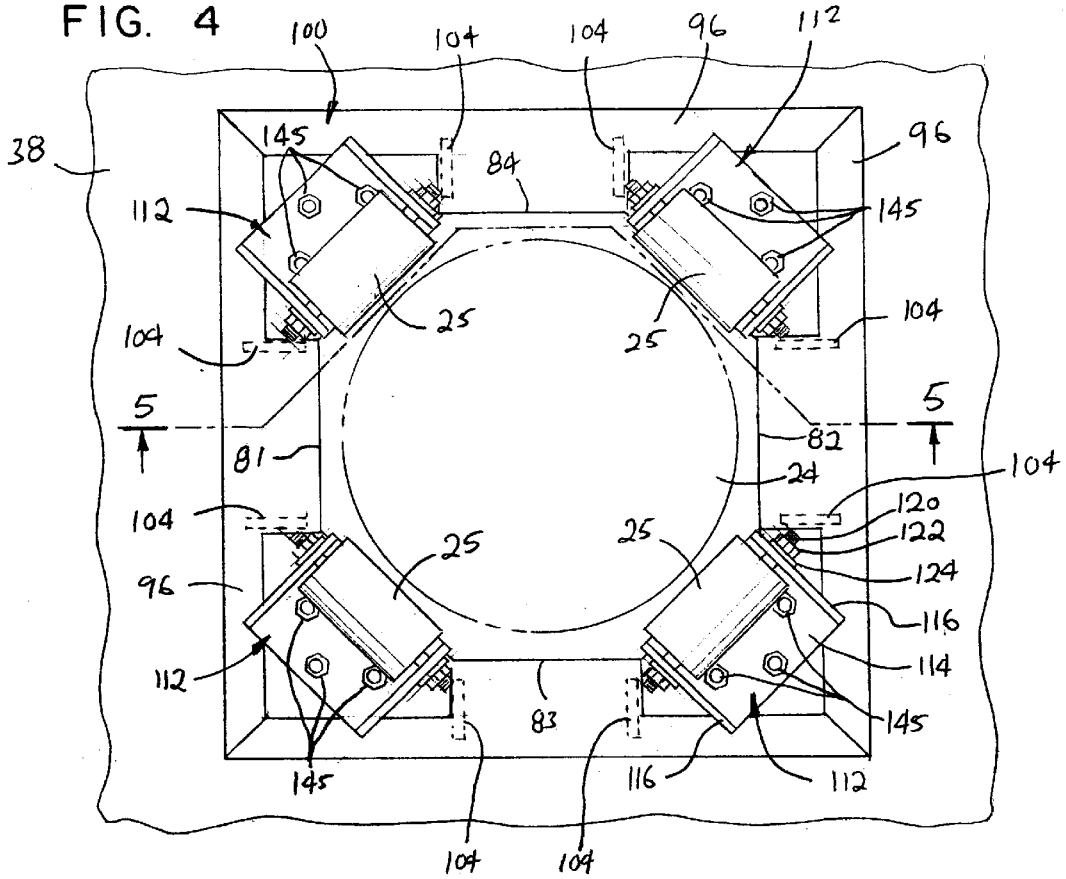
FIG. 4 is a top view of a portion of the module of FIGS. 1–3, in combination with a pile surrounded by the module.
Figure 5:
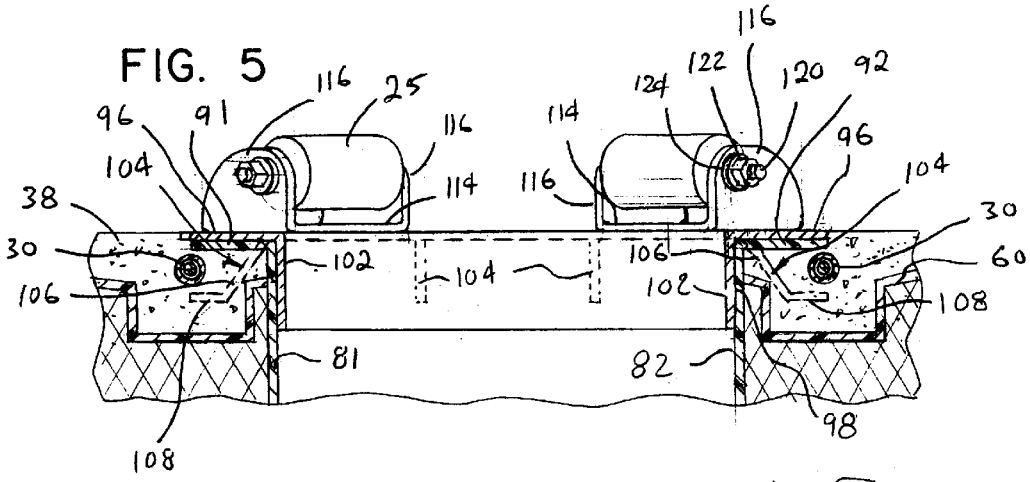
FIG. 5 is a side sectional view of the structure illustrated in FIG. 4, taken through the lines 5—5.

As illustrated in FIGS. 2 and 3, wooden wales 26, 27 and 28 and galvanized steel rods 30, having threaded ends, secure module 22 to the remaining modules 17 of finger pier 14. Wales 26–28 extend longitudinally along the upper portions of the buoyant modules 17 and 22 forming finger pier 14. Rods 30 extend transversely of the modules, through tunnels in the upper concrete deck portions of modules 17, 20 and 22 to hold wales 26–28 in place. Rods 30 are fixedly mounted to the outer walls of wales 26 by nuts 32 that are threaded onto the threaded ends of rods 30. Nuts 32 are tightened against washers 34 which abut the side walls of wales 26.

As illustrated in FIG. 2, pile 24, preferably a galvanized steel cylinder having a circular cross section, is driven into the seabed where dock 10 is located. Pile 24 is driven into the seabed after float module 22 has been put into place. Pile 24 is positioned so it extends through central opening 36 in pile float 22. Opening 36 which has a square configuration when viewed from the top of float 22, extends completely from the top substantially planar face of concrete deck 38 to the bottom edge of pile float 22.

Figure 7:
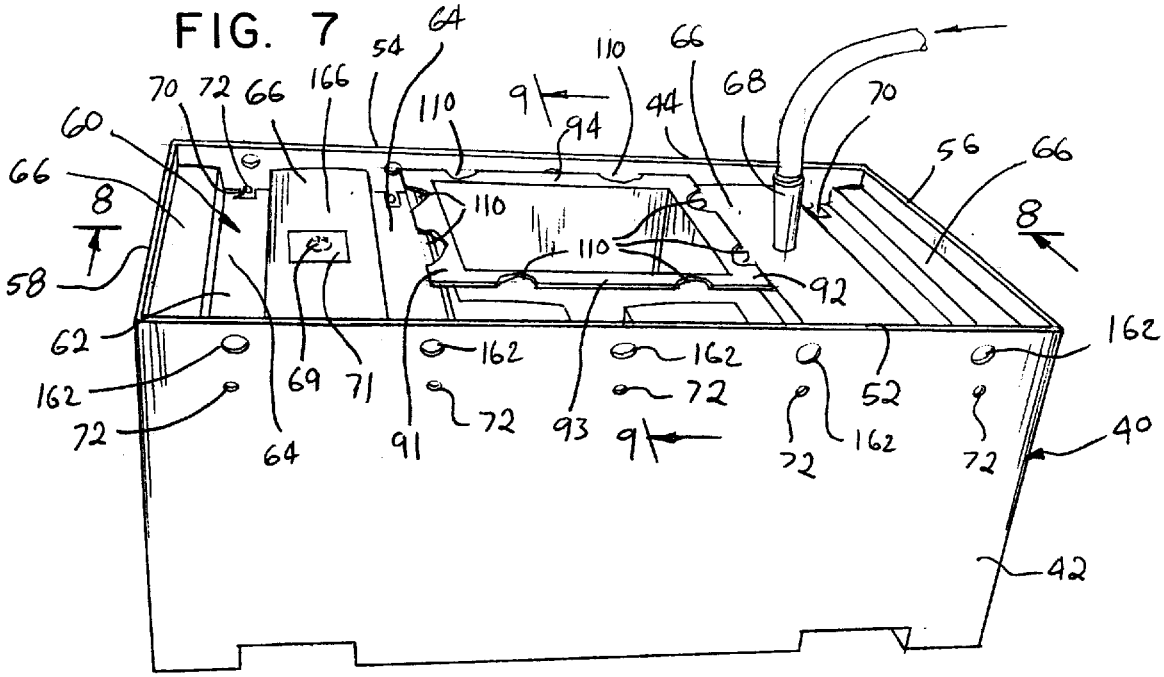
FIG. 7 is a perspective view of a portion of the module illustrated in FIGS. 1–6, prior to insulation of a plate carrying rollers and while the module is being filled with steam foam that forms a closed cell mass within a shell of the module.
Figure 8:
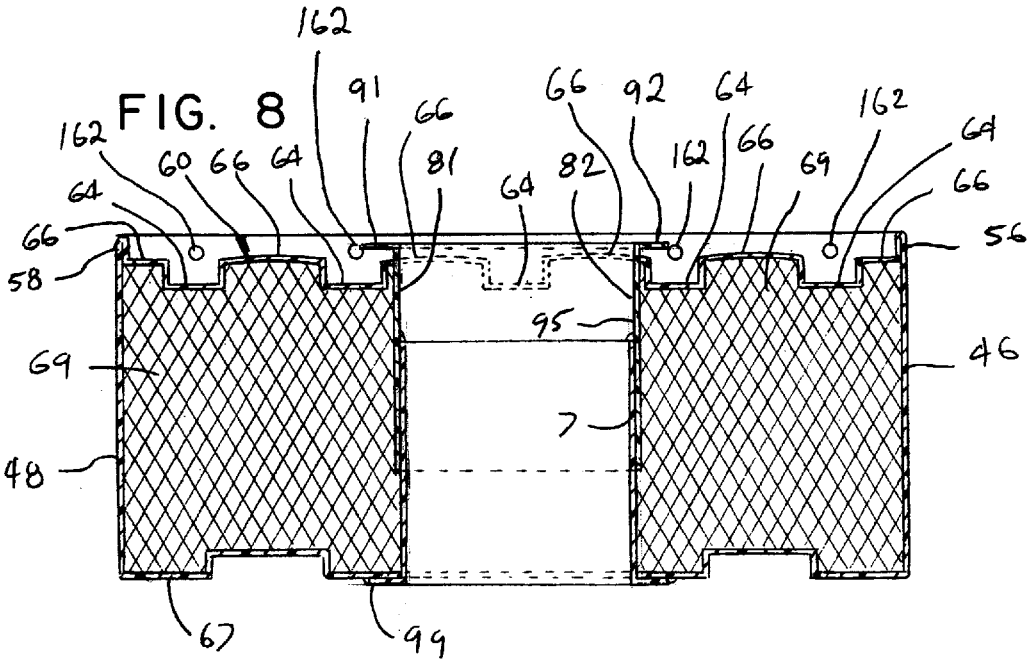
FIG. 8 is a longitudinal sectional view taken through the lines 8—8 of FIG. 7.
Figure 9:
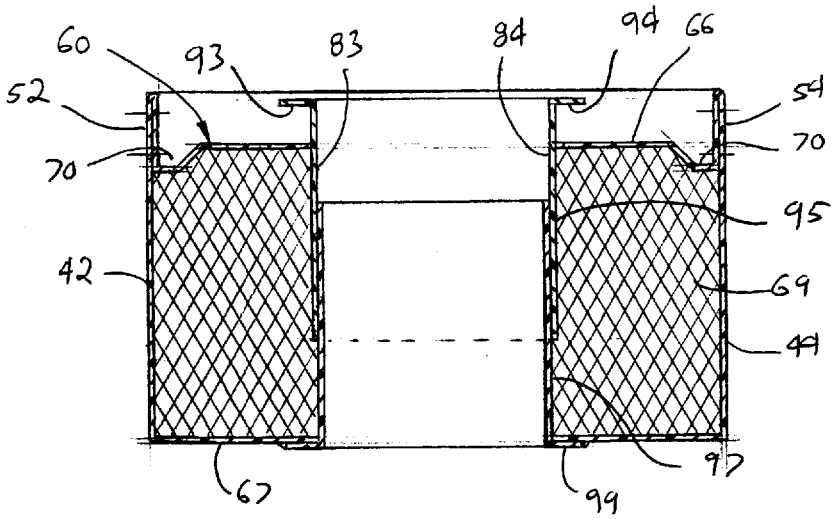
FIG. 9 is a transverse sectional view taken through the lines 9—9 of FIG. 7.
Figure 10:
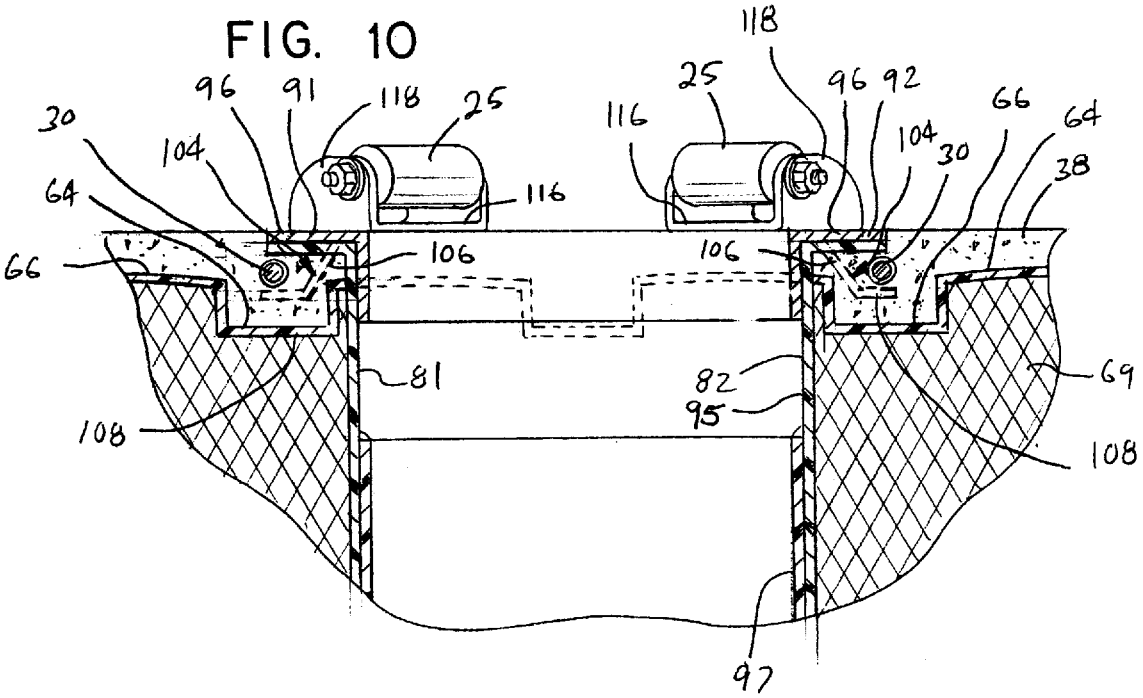
FIG. 10 is a cross sectional view of the module illustrated in FIGS. 7–9, with a plate carrying rollers installed thereon anchored in a concrete mass.

As illustrated in FIGS. 7–9, pile float 22 includes tub 40, preferably formed of rotary molded polyethylene. Tub 40 includes straight longitudinally extending exterior walls 42 and 44, as well as straight transversely extending exterior walls 46 and 48, which are at right angles to the longitudinally extending walls. Walls 42, 44, 46 and 48 respectively include upper lip portions 52, 54, 56 and 58 having co-planar upper edges. Lips 52–58, in combination with floor 60 that extends between the lips, provide a permanent mold form for a concrete aggregate-water mixture. The mixture is poured into the mold form and sets around a reinforcing mesh (not shown), as well as around liner tubes (not shown) having supporting rods therein to form concrete deck mass 38 as described in the previously mentioned co-pending, commonly assigned application.

Prior to the concrete aggregate-water mixture being poured into the mold form including lips 52–58 and floor 60, steamed polystyrene is injected through openings 166 via nozzle 68 into a closed shell defined by walls 42–48, floor 60 and bottom 67. The steamed polystyrene forms buoyant foam mass 69. After foam mass 69 has been injected through openings 166 into the shell including walls 42–48, the openings are sealed close by placing a water impervious patch 71 over each opening. Patches 71 are sealed to floor 60 by a water impervious plastic sealing agent. Foam mass 69 has sufficient compressive strength and is located immediately below floor 60 to enable the permanent mold form, including lips 52–58 and floor 60, to remain stable, i.e., not deflect substantially as the concrete aggregate-water mixture is being poured into the permanent mold form.

Floor 60 includes troughs 64 and mesas 66 with provisions for removing water from set concrete mass 38. As described in greater detail in the co-pending application, water removal is accomplished by sloping troughs 64 and mesas 66 and providing sumps 70 in the troughs adjacent walls 42 and 44. Each of sumps 70 includes an opening 72 through which the water collected by the sumps flows. The set concrete mass 38 in each of troughs 62 has a lined tunnel extending through it; the tunnels are aligned with holes 162 in lips 52 and 54. One of rods 30 extends through each of the tunnels.

From the foregoing, module 22 through which pile 24 extends has geometry and buoyancy properties similar to the geometry and buoyancy properties of the remaining buoyant wharf modules 17 and 20 of dock 10. Accordingly, module 22 does not substantially affect the buoyancy and stability of dock 10, so module 22 can be placed anywhere in dock 10 without substantially affecting dock stability.

Opening 36 through which pile 24 extends and rollers 25, as well as the structures carrying the rollers and associated with the opening, are the only substantial differences between module 22 and the remaining modules 17 and 20 of dock 10. Opening 36 includes four straight vertically extending side walls 81–84 arranged to define square opening (i.e., passage) 36 in the horizontal plane. Side walls 81–84 extend from the bottom 67 of tub 40 almost to the top face of concrete deck mass 38. The four straight walls 81–84 facilitate molding of tub 40. Molding of tub 40 is also facilitated by forming the walls of passage 36 in two parts, namely, an upper part 95 and a lower part 97. Upper and lower parts 95 and 97 of passage 36 are bonded to each other by a plastic water impervious sealant. The lower end of part 97 includes flanges 99 that extend at right angles to walls 81–84 and are sealed to floor 67. The junction of walls 81–84 and floor 60 is also sealed. The arrangement forms a unitary, water impervious one-piece tub 40 including the permanent mold form and shell.

Interior side walls 81–84 of tub 40 that define opening 36 are arranged so lips 85–88 respectively extend above floor 60. Lips 85–88 and lips 52–58 that extend above exterior side walls 42–48, in combination with floor 60, form the permanent mold form for the concrete aggregate and water mixture that forms concrete mass 38.

Lips 85–88 are also molded to include flanges 91–94 that respectively extend outwardly from the top edges of lips 85–88. Flanges 91–94 are substantially co-planar, extending in a horizontal plane so the top faces thereof are slightly below the top edges of lips 52–58 that extend above the exterior side walls 42–48. The spacing between the horizontal plane defined by the top faces of flanges 91–94 and the plane defined by the top co-planar edges of lips 52–58 is substantially equal to the thickness of co-planar horizontally extending flanges 96 of galvanized steel angle irons 98 of carrier 100 for rollers 25. Carrier 100, when in place on module 22, sits on flanges 96, includes rigid flaps 104 that are encapsulated in set concrete mass 38.

Carrier 100 includes four angle irons 98 which are welded to each other at diagonal ends of each angle iron to form a structure having square interior and exterior edges in the horizontal plane. Each of angle irons 98 includes a downwardly extending flange 102, as well as a pair of rigid flaps 104, that function as an anchor for carrier 100 in concrete mass 38. Flaps 104 on each angle iron 98 extend parallel to each other and at right angles to the length of the angle iron to which the particular flap is welded. In a vertical view of each of angle irons 98, each of flaps 104 includes a diagonal portion 106 that extends substantially at 45° to a horizontal plane and a horizontally extending end portion 108.

Each of flanges 91–94 includes a pair of cut-out regions 110, having positions corresponding with the positions of rigid flaps 104 when carrier 100 sits on flanges 91–94. Cut-out regions 110 are positioned and shaped to permit rigid flaps 104 to extend below flanges 91–94 into the region occupied by concrete mass 38.

Figure 6:
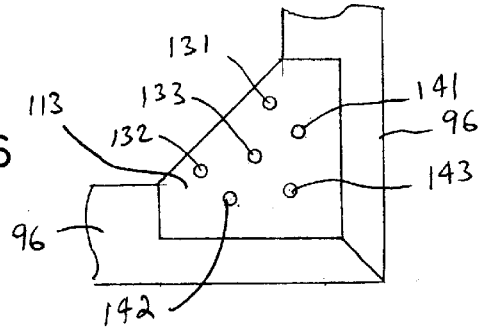
FIG. 6 is a top view of a portion of the structure illustrated in FIGS. 4 and 5.

Carrier 100 fixedly mounts cylindrical rollers 25 at different positions to enable module 22 to accommodate piles 24 having different diameters; in the preferred embodiment, piles with diameters of 16 inches and 20 inches can extend through opening 36 in float module 22. To these ends, each of rollers 25 is mounted on a bracket 112, located at the corners of carrier 100, i.e., at the four intersections of angle irons 98. Each bracket 112 is bolted to a separate plate 113 (FIG. 6) that is welded to each intersection of angle irons 96, at each corner of carrier 100.

Each of brackets 112 includes a base 114 and two ears 116, which extend upwardly from opposite ends of the base. Ears 116 include aligned circular openings through which extends horizontal, galvanized steel shaft 120, that in turn extends through a central horizontal circular opening in each of the cylindrical rollers 25. Shaft 120 is fastened to ears 116 by nuts 122 and washers 124. Nuts 122 are threaded on threads at opposite ends of shafts 120 to capture rollers 25 between interior, facing surfaces of ears 116.

To enable rollers 25 to operate with piles having two different diameters, brackets 112 can be located at two different radial positions relative to the center vertical axis of passage 36. To accomplish this result, plate 113 includes two sets of three threaded circular bores. The first set of bores consists of bores 131–133, while the second set of bores consists of bores 141–143. Each triad of bores is at an apex of a triangle having two equal length sides, with the first triad of bores 131–133 being located closer to the center of passage 36 than the second triad of bores 141–143. The two triangles are congruent, with the base of each triangle extending at 45° to the edges of angle irons 96. The base of each triangle is closer to the center of opening 36 than the apex of that triangle.

Base 114 of each of brackets 112 includes three bores (not shown) forming the apices of a triangle that is congruent with the triangles formed by bores 131–133 and 141–143. Bolts 145 are inserted into the bores in base 116 after the bores in base 116 have been aligned with the appropriate triad of bores 131–133 or 141–143. Bolts 145 then are threaded to bores 131–133 or 141–143, as appropriate, to secure brackets 112 and horizontally disposed rollers 25 in place at a position so that there is a slight gap between the rollers and pile 24. As float module 22 moves up and down with tide and wave action, only one of rollers 25 engages the outer surface of pile 24 at any particular time, to provide stability for module 22 and the remainder of dock 10.

While there has been described and illustrated a specific embodiment of the invention, it will be clear that variations in the details of the embodiment specifically illustrated and described may be made without departing from the true spirit and scope of the invention as defined in the appended claims.

We claim:

1. A buoyant module for securing other buoyant structures of a floating dock to a cylindrical pile fixedly mounted in a body of water, the pile having an exterior cylindrical wall and an upper segment extending substantially above the surface of the body of water, the module comprising an arrangement for connecting the module to the other buoyant structures, an upper deck portion and a lower buoyant portion, an interior wall arrangement forming a passage extending between bottom and top surfaces of the buoyant module, the passage including plural sides joined to form plural corners in a horizontal plane, a roller having a horizontally disposed axis at each of the corners, the sizes, geometry and locations of the passage and rollers relative to the pile being such that (a) the pile is always spaced from the sides, (b) there can be a gap between exterior cylindrical walls of all the rollers and the exterior cylindrical wall of the pile, (c) different ones of the rollers contact the upper segment of the pile at different times as the dock bobs in response to wave action of the body of water, and (d) only one of the rollers contacts the pile at a time.

2. The buoyant module of claim 1 wherein each of the rollers is mounted on a separate bracket, a removable fastener arrangement selectively securing each bracket to the buoyant module, the buoyant module being arranged for receiving the fastener arrangement at a plurality of locations having different radial spacings relative to a central vertical axis of the passage so that the same buoyant module can be used with piles having differing diameters.

3. The buoyant module of claim 1 wherein the lower buoyant portion includes a closed, water impervious molded shell having exterior walls and the interior wall arrangement is formed in the molded shell, a permanent mold form for a molded mass, the mold form including (a) lips extending upwardly from the interior wall arrangement and from the exterior walls and (b) a floor extending between the lips, the floor forming a roof of the shell, and a molded mass permanently filling the mold form.

4. The buoyant module of claim 3 wherein the shell includes first and second molded parts that are bonded together, so an intersection of the first and second molded parts is on the interior side wall arrangement, the first and second parts when bonded together including the interior side wall arrangement.

5. The buoyant module of claim 4 wherein the shell is substantially filled with a closed cellular foam.

6. The buoyant module of claim 1 wherein the upper portion includes a molded mass having a density greater than water, a carrier having a portion encapsulated in the molded mass so the carrier is fixedly secured to the molded mass, the brackets being carried by the carrier.

7. The buoyant module of claim 6 wherein the carrier includes downwardly depending flanges engaging the interior side wall arrangement.

8. The buoyant module of claim 7 wherein the carrier includes horizontally extending flanges that sit on horizontally extending flanges of the shell, the horizontally extending flanges of the shell being connected to the shell interior wall arrangement and extending outwardly from the shell interior wall arrangement.

9. The buoyant module of claim 1 wherein the lower portion includes a closed, water impervious molded shell having exterior walls and the interior wall arrangement is formed in the molded shell, a permanent mold form for a molded mass including (a) lips extending upwardly from the interior wall arrangement and from the exterior walls and (b) a floor extending between the lips, the floor forming a roof of the shell, and a molded mass having a density greater than water permanently filling the mold form.

10. The buoyant module of claim 9 wherein the molded shell is substantially filled with a closed cellular foam.

11. The buoyant module of claim 1 further including a carrier having a portion encapsulated in a molded mass having a density greater than water and forming a deck so the carrier is fixedly secured to the molded mass, the rollers being mounted for rotation about a horizontal axis on a structure carried by the carrier.

12. The buoyant module of claim 11 wherein the carrier includes horizontally extending flanges that sit on horizontally extending flanges of the shell, the horizontally extending flanges of the shell being connected to the shell interior wall arrangement and extending outwardly from the shell interior wall arrangement.

13. The buoyant module of claim 12 wherein the horizontally extending flange of the shell has a top face in a plane slightly below a top face of the deck, the carrier having a thickness so the carrier flange has a top face in substantially the same plane as the top face of the deck.

14. The buoyant module of claim 1 wherein the module is included in a floating dock having a plurality of other buoyant modules fixedly connected to the module of claim 1, each of said modules having approximately the same exterior size and shape and an upper deck portion, the upper deck portion of each of the modules having substantially the same (a) exterior size, (b) exterior shape and (c) thickness and materials having substantially the same density; the lower buoyant portion of each module, having the same exterior size, exterior shape and thickness and materials having substantially the same density.

15. The buoyant module of claim 14 wherein the floating dock is in combination with one of the piles, the pile extending through the passage of the module of claim 1.

16. A buoyant module for securing other buoyant structures of a floating dock to a pile fixedly mounted in a body of water, the pile having an upper segment extending substantially above the surface of the body of water, the module comprising an arrangement for connecting the module to the other buoyant structures, an upper deck portion and a lower buoyant portion, an interior wall arrangement forming a passage extending between bottom and top surfaces of the buoyant module, a plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time;

a structure carrying the rollers, the structure being arranged so exterior cylindrical surfaces of the rollers can be fixedly mounted at differing radial positions relative to a central vertical extending axis of the passage so piles having differing diameters can fit into the passage by changing the radial position of the rollers relative to the axis.

17. A buoyant module for securing other buoyant structures of a floating dock to a pile fixedly mounted in a body of water, the pile having an upper segment extending substantially above the surface of the body of water, the module comprising an arrangement for connecting the module to the other buoyant structures, an upper deck portion and a lower buoyant portion, an interior wall arrangement forming a passage extending between bottom and top surfaces of the buoyant module, a plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time;

the lower portion including a closed, water impervious molded shell having exterior walls, the interior wall arrangement being formed in the molded shell, a permanent mold form for a molded mass, the mold form including (a) lips extending upwardly from the interior wall arrangement and exterior walls of the shell, and (b) a floor extending between the lips, the floor forming a roof of the shell, and a molded mass permanently filling the mold form.

18. A buoyant module for securing other buoyant structures of a floating dock to a pile fixedly mounted in a body of water, the pile having an upper segment extending substantially above the surface of the body of water, the module comprising an arrangement for connecting the module to the other buoyant structures, an upper deck portion and a lower buoyant portion, an interior wall arrangement forming a passage extending between bottom and top surfaces of the buoyant module, a plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time;

the lower portion including a shell having first and second molded parts that are bonded together so an intersection of the first and second molded parts is on the interior side wall arrangement, the first and second parts when bonded together including the interior side wall arrangement.

19. A buoyant module for securing other buoyant structures of a floating dock to a pile fixedly mounted in a body of water, the pile having an upper segment extending substantially above the surface of the body of water, the module comprising an arrangement for connecting the module to the other buoyant structures, an upper deck portion including a molded mass having a density greater than water and a lower buoyant portion, an interior wall arrangement forming a passage extending between bottom and top surfaces of the buoyant module, a plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time;

a carrier for the rollers, the carrier having a portion encapsulated in the molded mass so the carrier is fixedly secured to the molded mass.

20. The buoyant module of claim 19 wherein the carrier includes downwardly depending flanges engaging the interior side wall arrangement.

21. The buoyant module of claim 20 wherein the carrier includes horizontally extending flanges that sit on horizontally extending flanges of the shell, the horizontally extending flanges of the shell being connected to the shell interior wall arrangement and extending outwardly from the shell interior wall arrangement.

22. In combination, a pile having a circular cross section, the pile being fixedly mounted in a seabed covered by a body of water, the pile having an upper segment extending above the water level of the body of water, a floating dock in the body of water, the dock including:

(a) an upper deck portion and a lower buoyant portion, (b) an interior wall arrangement forming a passage extending between bottom and top surfaces of the buoyant module, the passage including plural sides joined to form plural corners in a horizontal plane, (c) a roller having a horizontally disposed axis at each of the corners, the sizes, geometry and locations of the passage and rollers relative to the pile being such that (i) the pile is always spaced from the sides, (ii) there can be a gap between exterior cylindrical walls of all the rollers and the exterior cylindrical wall of the pile, (iii) different ones of the rollers contact the upper segment of the pile at different times as the dock bobs in response to wave action of the body of water, and (iv) only one of the rollers contacts the pile at a time.

23. A floating dock adapted to be secured to an upper, above water segment of a pile fixedly mounted in a seabed, the dock comprising an upper deck portion and a lower buoyant portion, an interior wall arrangement forming a passage extending between bottom and top surfaces of the dock, the passage including plural sides joined to form plural corners in a horizontal plane, a roller having a horizontally disposed axis at each of the corners, the sizes, geometry and locations of the passage and rollers relative to the pile being such that (a) the pile is always spaced from the sides, (b) there can be a gap between exterior cylindrical walls of all of the rollers and the exterior cylindrical wall of the pile, (c) different ones of the rollers contact the upper segment of the pile at different times as the dock bobs in response to wave action of the body of water, and (d) only one of the rollers contacts the pile at a time.

24. In combination, a pile having a circular cross section, the pile being fixedly mounted in a seabed covered by a body of water, the pile having an upper segment extending above the water level of the body of water, a floating dock in the body of water, the dock including:

(a) an upper deck portion and a lower buoyant portion, (b) an interior wall arrangement forming a passage extending between bottom and top surfaces of the dock, (c) a plurality of rollers each having a horizontally disposed axis, the rollers being fixedly mounted to extend into a region vertically aligned with the passage, the sizes and locations of the pile, passage and rollers being such that (i) the pile is always spaced from side walls of the passage, (ii) there can be a gap between exterior cylindrical walls of all the rollers and the exterior cylindrical wall of the pile, (iii) different ones of the rollers can contact the upper segment of the pile at different times as the dock bobs in response to wave action of the body of water, and (iv) only one of the rollers can contact the pile at a time; and (d) a structure carrying the rollers, the structure being arranged so exterior cylindrical surfaces of the rollers can be fixedly mounted at differing radial positions relative to a central vertical extending axis of the passage so piles having differing diameters can fit into the passage by changing the radial position of the rollers relative to the axis.

25. A floating dock adapted to be secured to an upper, above water segment of a pile fixedly mounted in a seabed, the dock comprising an upper deck portion and a lower buoyant portion, an interior wall arrangement forming a passage extending between bottom and top surfaces of the dock, a plurality of rollers each having a horizontally disposed axis, the rollers being fixedly mounted to extend into a region vertically aligned with the passage, the sizes and locations of the pile, passage and rollers being such that (a) the pile is always spaced from side walls of the passage, (b) there can be a gap between exterior cylindrical walls of all the rollers and the exterior cylindrical wall of the pile, (c) different ones of the rollers can contact the upper segment of the pile at different times as the dock bobs in response to wave action of the body of water, and (d) only one of the rollers can contact the pile at a time;

a structure carrying the rollers, the structure being arranged so exterior cylindrical surfaces of the rollers can be fixedly mounted at differing radial positions relative to a central vertical extending axis of the passage so piles having differing diameters can fit into the passage by changing the radial position of the rollers relative to the axis.

26. In combination, a pile having a circular cross section, the pile being fixedly mounted in a seabed covered by a body of water, the pile having an upper segment extending above the water level of the body of water, a floating dock in the body of water, the dock including:

(a) an upper deck portion and a lower buoyant portion, the upper deck portion including a molded mass having a density greater than water, (b) an interior wall arrangement forming a passage extending between bottom and top surfaces of the dock, (c) a plurality of rollers each having a horizontally disposed axis, the rollers being fixedly mounted to extend into a region vertically aligned with the passage, the sizes and locations of the pile, passage and rollers being such that (i) the pile is always spaced from side walls of the passage, (ii) there can be a gap between exterior cylindrical walls of all the rollers and the exterior cylindrical wall of the pile, (iii) different ones of the rollers can contact the upper segment of the pile at different times as the dock bobs in response to wave action of the body of water, and (iv) only one of the rollers can contact the pile at a time;

(d) a carrier for the rollers, the carrier having a portion encapsulated in the molded mass so the carrier is fixedly secured to the molded mass.

27. A floating dock adapted to be secured to an upper, above water segment of a pile fixedly mounted in a seabed, the dock comprising (a) an upper deck portion and a lower buoyant portion, the upper deck portion including a molded mass having a density greater than water, (b) an interior wall arrangement forming a passage extending between bottom and top surfaces of the dock, (c) a plurality of rollers each having a horizontally disposed axis, the rollers being fixedly mounted to extend into a region vertically aligned with the passage, the sizes and locations of the pile, passage and rollers being such that (i) the pile is always spaced from side walls of the passage, (ii) there can be a gap between exterior cylindrical walls of all the rollers and the exterior cylindrical wall of the pile, (iii) different ones of the rollers can contact the upper segment of the pile at different times as the dock bobs in response to wave action of the body of water, and (iv) only one of the rollers can contact the pile at a time; and (d) a carrier for the rollers, the carrier having a portion encapsulated in the molded mass so the carrier is fixedly secured to the molded mass.

28. In combination, a pile having a circular cross section, the pile being fixedly mounted in a seabed covered by a body of water, the pile having an upper segment extending above the water level of the body of water, a floating dock in the body of water, the dock including:

a plurality of buoyant wharf modules secured to each other, each of said modules having approximately the same exterior dimensions, density and buoyancy characteristics, one of said modules including:

(a) an interior wall arrangement forming a passage extending between bottom and top surfaces of said one buoyant module, the passage including plural sides joined to form plural corners in a horizontal plane, (b) a roller having a horizontally disposed axis at each of the corners, the sizes, geometry and locations of the passage and rollers relative to the pile being such that (i) the pile is always spaced from the sides, (ii) there can be a gap between exterior cylindrical walls of all of the rollers and the exterior cylindrical wall of the pile, (iii) different ones of the rollers contact the upper segment of the pile at different times as the dock bobs in response to wave action of the body of water, and (iv) only one of the rollers contacts the pile at a time.

29. The combination of claim 28 wherein each of the rollers is mounted on a separate bracket, a removable fastener arrangement selectively securing each bracket to said one buoyant module, said one buoyant module being arranged for receiving the fastener arrangement at a plurality of locations having different radial spacings relative to a central vertical axis of the passage so that the same buoyant module can be used with piles having differing diameters.

30. The combination of claim 28 wherein said one module includes a closed, water impervious molded shell having exterior walls, the interior wall arrangement being formed in the molded shell, a permanent mold form for a molded mass, the mold form including (a) lips extending upwardly from the interior wall arrangement and the exterior walls of the shell and (b) a floor extending between the lips, the floor forming a roof of the shell, and a molded mass permanently filling the mold form.

31. The combination of claim 28 wherein an upper deck portion of said one module includes a molded mass having a density greater than water, a carrier having a portion encapsulated in the molded mass so the carrier is fixedly secured to the molded mass, and brackets for holding the rollers, the brackets being carried by the carrier.

32. The combination of claim 28 wherein a lower buoyant portion of said one module includes a closed, water impervious molded shell having exterior walls, the interior wall arrangement being formed in the molded shell, a permanent mold form for a molded mass including (a) lips extending upwardly from the interior wall arrangement and the exterior walls of the shell and (b) floor extending between the lips, the floor forming a roof of the shell, and a molded mass having a density greater than water permanently filling the mold form.

33. The combination of claim 32 wherein the molded shell is substantially filled with a closed cellular foam.

34. The combination of claim 28 further including a carrier having a portion encapsulated in a molded mass having a density greater than water, the molded mass being included in a deck of said one module, the carrier being fixedly secured to the molded mass, the rollers being mounted for rotation about a horizontal axis on a structure carried by the carrier.

35. The combination of claim 28, further including a structure carrying the rollers, the structure and the carrier being arranged so exterior cylindrical surfaces of the rollers can be fixedly mounted at differing radial positions relative to a central vertical extending axis of the passage so piles having differing diameters can fit into the passage by changing the radial position of the rollers relative to the axis.

36. A floating dock adapted to be secured to an upper, above water segment of a pile fixedly mounted in a seabed, the dock comprising a plurality of buoyant wharf modules secured to each other, each of said modules having approximately the same exterior dimensions, density and buoyancy characteristics, one of said modules including:

an interior wall arrangement forming a passage extending between bottom and top surfaces of said one buoyant module, the passage having an interior wall arrangement including plural sides joined to form plural corners in a horizontal plane, a roller having a horizontally disposed axis at each of the corners, the sizes, geometry and locations of the passage and rollers relative to the pile being such that (a) the pile is always spaced from the sides, (b) there can be a gap between exterior cylindrical walls of all of the rollers and the exterior cylindrical wall of the pile, (c) so different ones of the rollers contact the upper segment of the pile at different times as the dock bobs in response to wave action of the body of water, and (d) only one of the rollers contacts the pile at a time.

* * * * *